US009797686B2

(12) United States Patent
Chesney

(10) Patent No.: US 9,797,686 B2
(45) Date of Patent: Oct. 24, 2017

(54) RANGEFINDER SYSTEM

(71) Applicant: Shawn Chesney, Barrie (CA)

(72) Inventor: Shawn Chesney, Barrie (CA)

( * ) Notice: Subject to any disclaimer, the term of this patent is extended or adjusted under 35 U.S.C. 154(b) by 119 days.

(21) Appl. No.: 15/015,504

(22) Filed: Feb. 4, 2016

(65) Prior Publication Data

US 2017/0227326 A1 Aug. 10, 2017

(51) Int. Cl.
*F41G 1/467* (2006.01)

(52) U.S. Cl.
CPC ..... *F41G 1/467* (2013.01)

(58) Field of Classification Search
CPC ..... F41G 1/467
USPC ..... 33/265
See application file for complete search history.

(56) References Cited

U.S. PATENT DOCUMENTS 3,431,652 A * 3/1969 Leatherwood ..... F41G 1/38 33/353
3,696,517 A * 10/1972 Larson ..... F41G 1/467 33/265
4,016,654 A * 4/1977 Tepedino ..... G01C 3/22 33/277
4,617,741 A 10/1986 Bordeaux
5,495,675 A 3/1996 Huang
5,575,072 A * 11/1996 Eldridge ..... F41G 1/467 124/87
5,671,724 A * 9/1997 Priebe ..... F41G 1/467 124/87
6,021,770 A 2/2000 Sodaro
6,073,352 A * 6/2000 Zykan ..... F41G 1/467 33/265
6,681,755 B2 1/2004 Pujos
6,796,038 B2 9/2004 Humphries
7,255,035 B2 * 8/2007 Mowers ..... F41G 1/467 42/131
D662,168 S 6/2012 Sims et al.
8,276,282 B2 * 10/2012 Mainsonneuve ..... F41G 1/467 124/87
8,336,216 B2 * 12/2012 Samuels ..... F41G 1/467 124/87
8,839,776 B2 9/2014 Kingsbury et al.
8,893,701 B1 11/2014 Entrup
8,939,140 B2 1/2015 Mancini
9,441,913 B1 * 9/2016 Donahoe ..... F41G 1/467
9,568,278 B1 * 2/2017 Jordan ..... F41G 1/467
2003/0233757 A1 * 12/2003 Nordberg ..... F41G 1/467 33/265
2010/0115778 A1 * 5/2010 Gorsuch ..... F41G 1/467 33/265

(Continued)

*Primary Examiner* — G. Bradley Bennett

(57) ABSTRACT

A rangefinder system includes a bow that may launch an arrow. A range finder is provided and the range finder may determine a distance between the bow and a target. A mount is coupled to the bow such that the mount is directed forwardly from the bow. The range finger is coupled to the mount such that the mount directs the range finder forwardly with respect to the bow. A switch is coupled to the bow and the switch may be manipulated. The switch is electrically coupled to the range finder such that the switch turns the range finder on and off. A display is movably coupled to the bow and the display may be visible. The display is electrically coupled to the range finder and the display displays a distance between the range finder and the target.

6 Claims, 5 Drawing Sheets

(56) References Cited

U.S. PATENT DOCUMENTS

| | | | | |
|---|---|---|---|---|
| 2010/0258628 | A1* | 10/2010 | Bay | F41G 1/35<br>235/404 |
| 2010/0282233 | A1* | 11/2010 | Volpe | F41G 3/06<br>124/87 |
| 2011/0120438 | A1* | 5/2011 | Samuels | F41G 1/467<br>124/87 |
| 2015/0040409 | A1* | 2/2015 | Morrison | F41B 5/1492<br>33/228 |
| 2015/0267998 | A1* | 9/2015 | Grace, Jr. | F41G 1/345<br>42/117 |
| 2015/0362286 | A1* | 12/2015 | Sandknop | F41G 1/467<br>33/228 |

* cited by examiner

RANGEFINDER SYSTEM

BACKGROUND OF THE DISCLOSURE

Field of the Disclosure

The disclosure relates to rangefinder devices and more particularly pertains to a new rangefinder device for coupling a range finder to an archery bow.

SUMMARY OF THE DISCLOSURE

An embodiment of the disclosure meets the needs presented above by generally comprising a bow that may launch an arrow. A range finder is provided and the range finder may determine a distance between the bow and a target. A mount is coupled to the bow such that the mount is directed forwardly from the bow. The range finger is coupled to the mount such that the mount directs the range finder forwardly with respect to the bow. A switch is coupled to the bow and the switch may be manipulated. The switch is electrically coupled to the range finder such that the switch turns the range finder on and off. A display is movably coupled to the bow and the display may be visible. The display is electrically coupled to the range finder and the display displays a distance between the range finder and the target.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
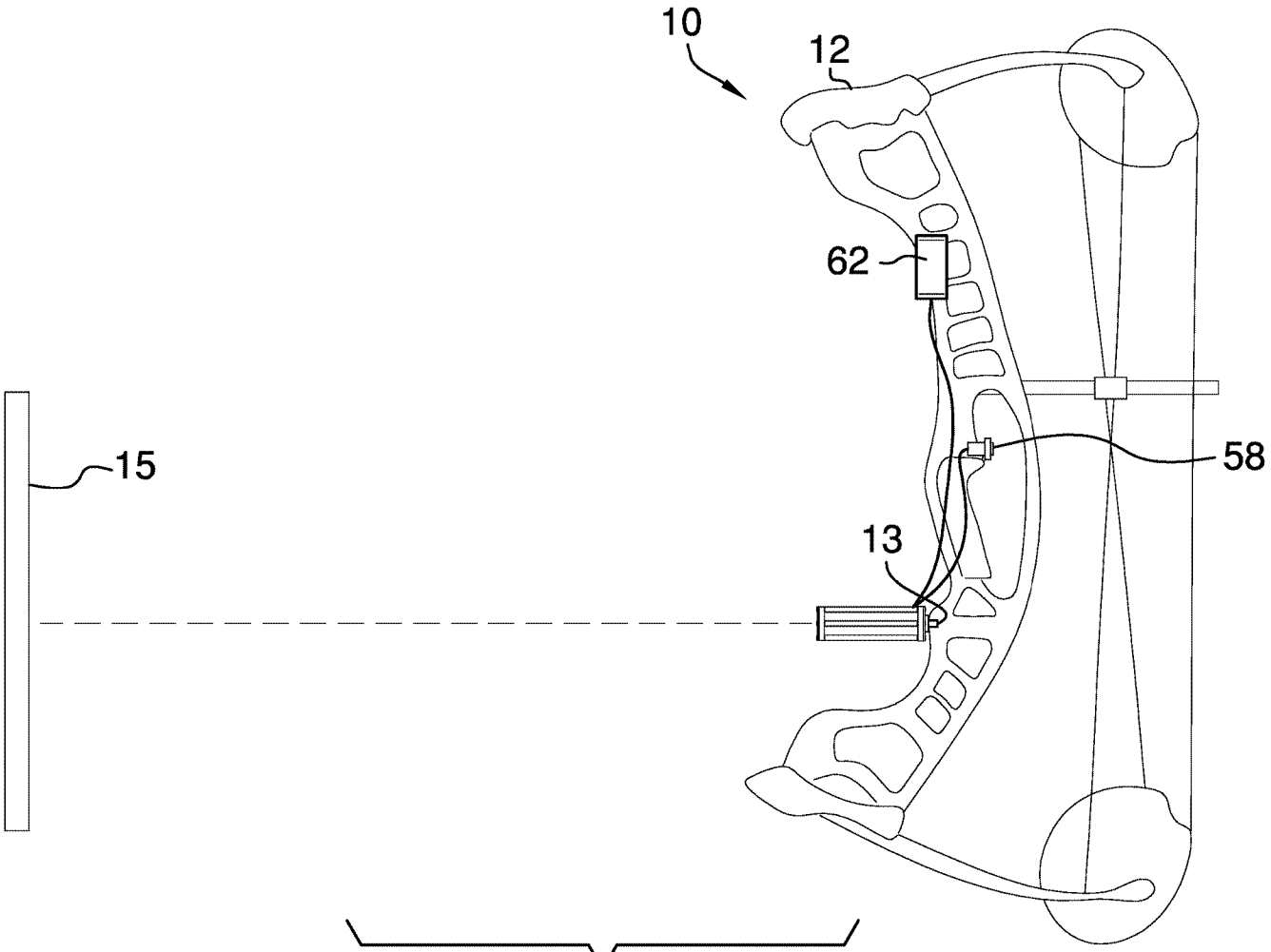
FIG. 1 is a perspective in-use view of a rangefinder system according to an embodiment of the disclosure.
Figure 2:
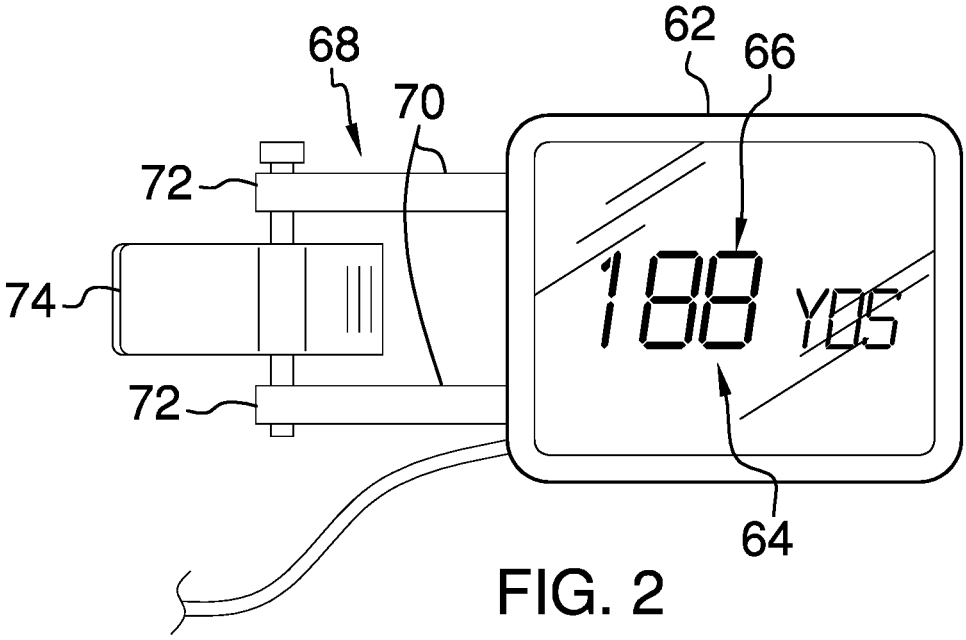
FIG. 2 is a front view of display of an embodiment of the disclosure.
Figure 3:
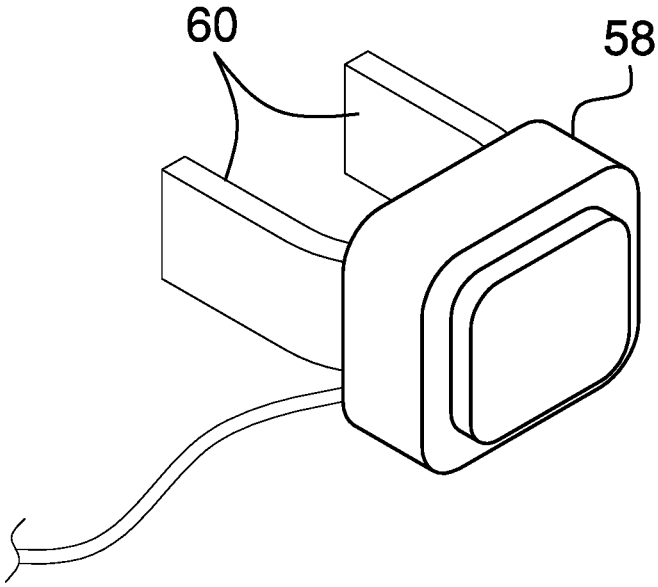
FIG. 3 is a front perspective view of a switch of an embodiment of the disclosure.
Figure 4:
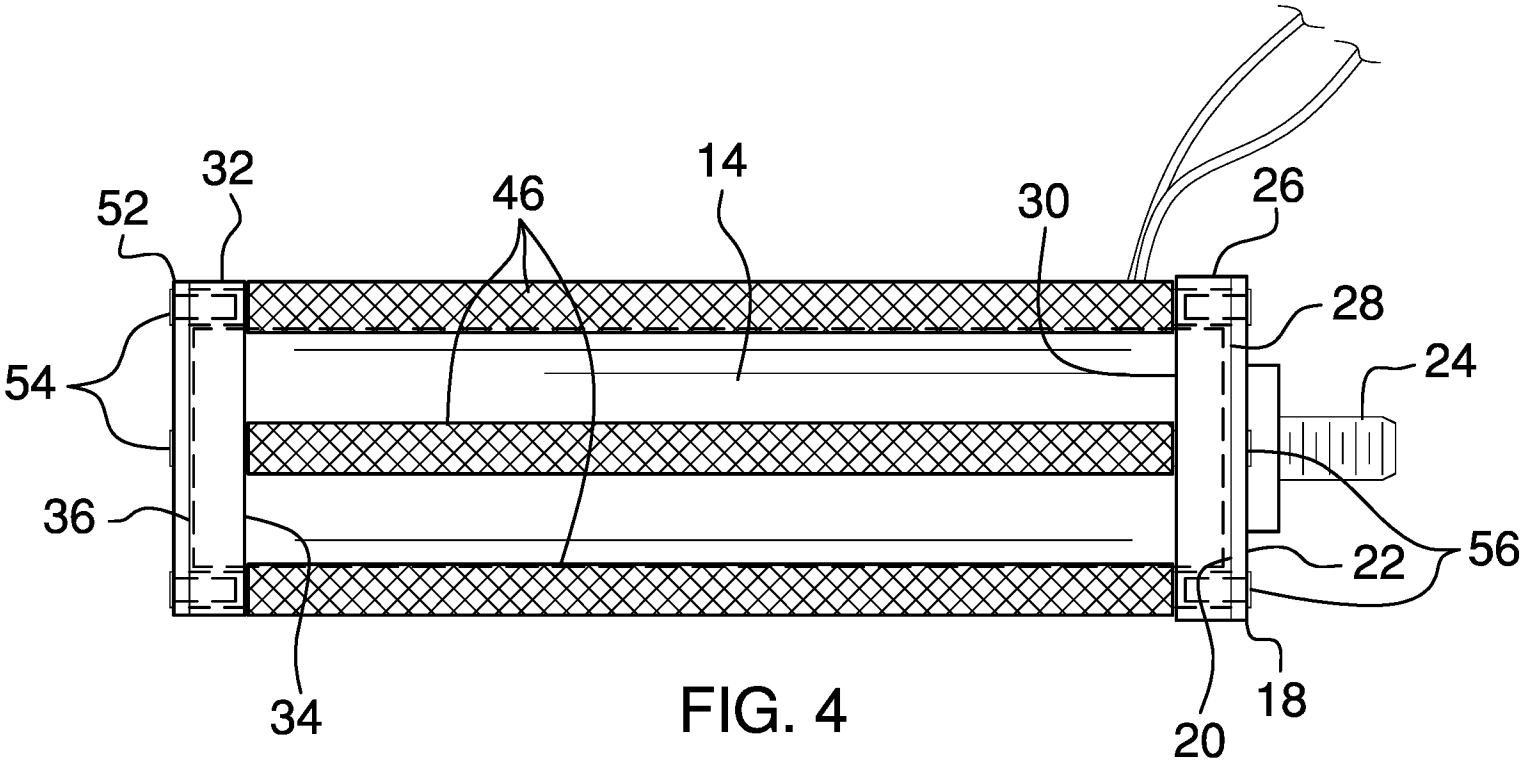
FIG. 4 is a left side view of an embodiment of the disclosure.
Figure 5:
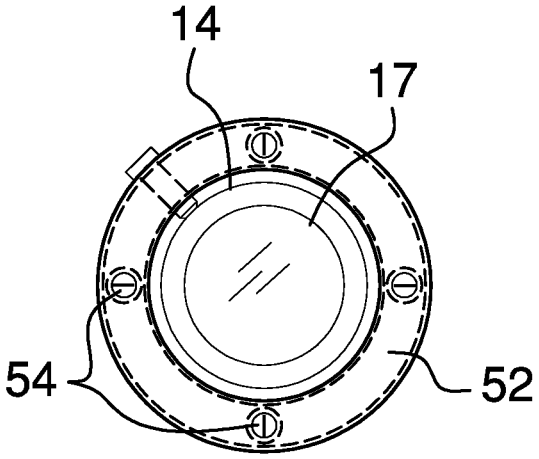
FIG. 5 is a front view of an embodiment of the disclosure.
Figure 6:
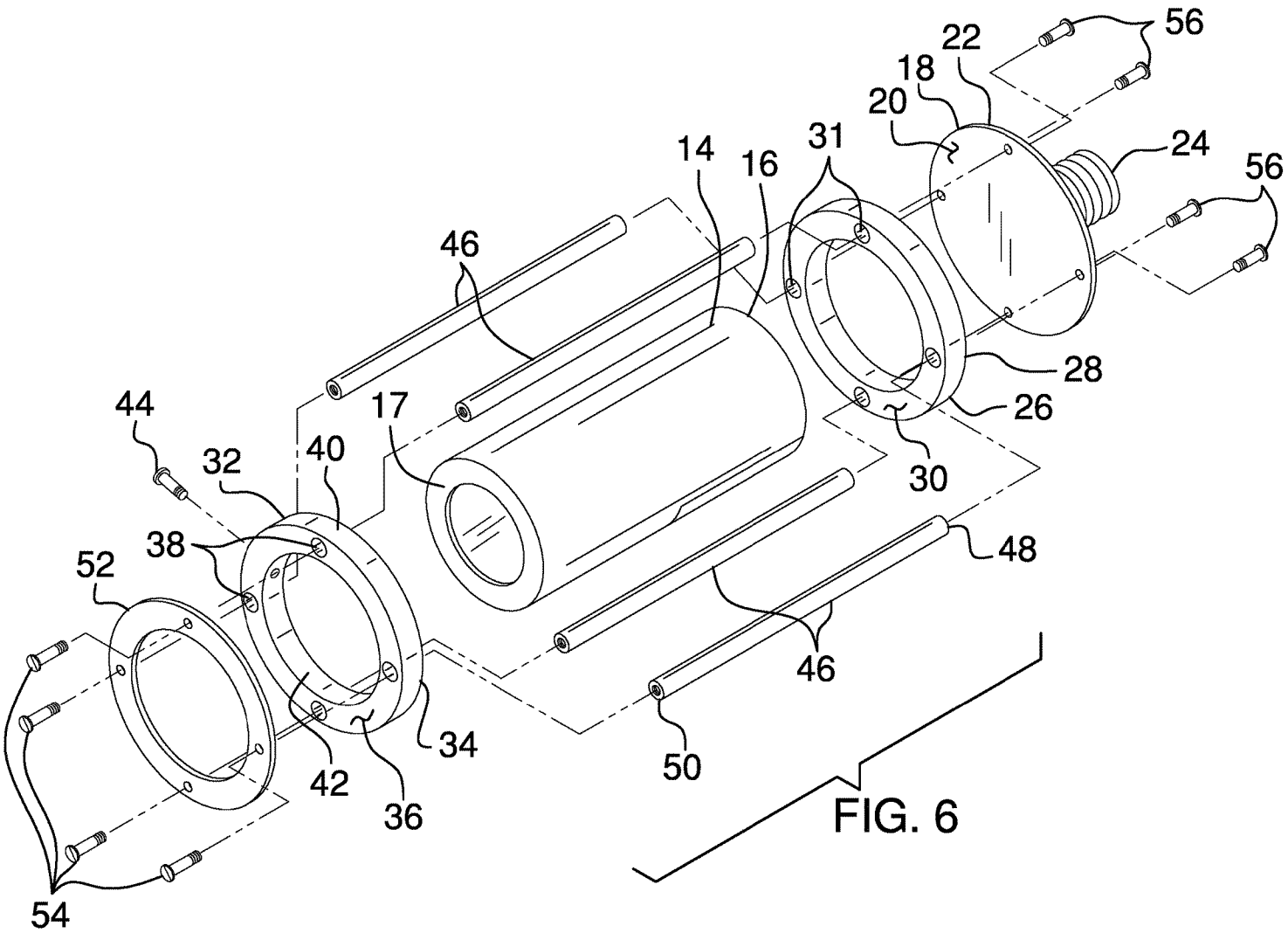
FIG. 6 is an exploded perspective view of an embodiment of the disclosure.

With reference now to the drawings, and in particular to FIGS. 1 through 6 thereof, a new rangefinder device embodying the principles and concepts of an embodiment of the disclosure and generally designated by the reference numeral 10 will be described.

As best illustrated in FIGS. 1 through 6, the rangefinder system 10 generally comprises a bow 12 that may launch an arrow. The bow 12 may comprise a compound bow or the like and the bow 12 has a stabilizer mount 13. A range finder 14 is provided and the range finder 14 may determine a distance between the bow 12 and a target 15. The range finder 14 has a first end 16 and a second end 17, and the range finder 14 may comprise a laser range finder or the like.

A mount 14 is coupled to the bow 12. The mount 14 is directed forwardly from the bow 12. The range finger 16 is coupled to the mount 14. Thus, the mount 14 directs the range finder 14 forwardly with respect to the bow 12.

The mount 14 comprises a plate 18 that has a first surface 20 and a second surface 22. The plate 18 includes a bolt 24 that is coupled to and extends away from the second surface 22. The bolt 24 is centrally positioned on the plate 18. The bolt 24 threadably engages the stabilizer mount 13 on the bow 12 such that the plate 18 is coupled to the bow 12.

A first ring 26 is provided. The first ring 26 has a first surface 28 and a second surface 30. The first surface 28 of the first ring 26 abuts the first surface 20 of the plate 18 and the first ring 26 surrounds the first end 16 of the range finder 14. The first ring 26 has a plurality of first openings 31 extending through the first surface 28 and the second surface 30. The first openings 31 are spaced apart from each other and distributed around the first ring 26. The first ring 26 may be comprised of a resiliently compressible material such as rubber.

A second ring 32 is provided that has a primary surface 34 and a secondary surface 36. The second ring 32 is spaced from the first ring 26 and the second ring 32 surrounds the second end 17 of the range finder 14. The second ring 32 has a plurality of second openings 38 extending through the primary surface 34 and the secondary surface 36. Each of the second openings 38 is aligned with an associated one of the first openings 31. The second ring 32 may be comprised of a resiliently compressible material such as rubber.

The second ring 32 has an outwardly facing edge 40 and an inwardly facing edge 42. A set screw 44 extends through the outwardly facing edge 40 and the inwardly facing edge 42. The set screw 44 engages the range finder 14. Thus, the range finder 14 is retained at a selected angle of rotation in the second ring 32.

A plurality of rods 46 is provided. Each of the rods 46 has a first end 48 and a second end 50. The first end 48 of each of the rods 46 is open and the second end 50 of each of the rods 46 is open. The first end 48 of each of the rods 46 extends through an associated one of the first openings 31. The second end 50 of each of the rods 46 extends through an associated one of the second openings 38. Each of the rods 46 may be comprised of a rigid material such as carbon fiber.

A washer 52 is positioned on the secondary surface 36 of the second ring 32. A plurality of first fasteners 54 is provided. Each of the first fasteners 54 extends through the plate 18 and engages the first end 48 of an associated one of the rods 46. Thus, each of the rods 46 is coupled to the plate 18. Each of the first fasteners 54 may comprise a screw or the like.

A plurality of second fasteners 56 is provided. Each of the second fasteners 56 extends through the washer 52 and engages the second end 50 of an associated one of the rods 46. Thus, the first ring 26 and the second ring 32 and retain the range finder 14 on the mount 14. Each of the second fasteners 56 may comprise a screw or the like.

A switch 58 is coupled to the bow 12 and the switch 58 may be manipulated. The switch 58 is electrically coupled to the range finder 14. Thus, the switch 58 turns the range finder 14 on and off. A pair of legs 60 may each be coupled to the switch 58. The legs 60 may be spaced apart from each other. Thus, the bow 12 may be positioned between each of the legs 60. Each of the legs 60 may be coupled to the bow 12 thereby retaining the switch 58 on the bow 12.

A display 62 is movably coupled to the bow 12 and the display 62 is positioned to be visible. The display 62 is electrically coupled to the range finder 14. The display 62 displays indicia 64 when the range finder 14 is turned on. The indicia 64 comprise numbers 66 relating to a distance between the range finder 14 and the target 15. The display 62 may comprise an LED display or the like.

A display mount 68 may be provided. The display mount 68 may have a pair of arms 70 each coupled to and extending away from the display 68. The arms 70 may be spaced apart from each other. Each of the arms 70 may have a distal end 72 with respect to the display 68. A coupler 74 may be hingedly coupled between the distal ends 72 and the coupler may 74 be coupled to the bow 12. Thus, the display 62 may be movably retained on the bow 12. The coupler 74 may comprise a spring loaded clip or the like.

In use, the bow 12 is manipulated to point the range finder 14 toward the target 15. The switch 58 is manipulated to turn the range finder 14 on. The display 62 displays the distance to the target 15 as determined by the range finder 17. The display 62 is observed and the bow 12 is manipulated to facilitate the arrow to travel to the distance to the target 15. Thus, the arrow is facilitated to accurately strike the target 15.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A rangefinder system comprising:

a bow being configured to launch an arrow;

a range finder being configured to determine a distance between said bow and a target;

a mount being coupled to said bow such that said mount is directed forwardly from said bow, said range finger being coupled to said mount such that said mount directs said range finder forwardly with respect to said bow;

a switch being coupled to said bow wherein said switch is configured to be manipulated, said switch being electrically coupled to said range finder such that said switch turns said range finder on and off; and a display being movably coupled to said bow wherein said display is configured to be visible, said display being electrically coupled to said range finder, said display displaying indicia when said range finder is turned on, said indicia comprising numbers wherein said display is configured to display a distance between said range finder and the target.

2. The assembly according to claim 1, wherein said mount comprises a plate having a first surface and a second surface, said plate including a bolt being coupled to and extending away from said second surface, said bolt being centrally positioned on said plate, said bolt threadably engaging a stabilizer mount on said bow such that said plate is coupled to said bow.

3. The assembly according to claim 2, further comprising:

a first ring having a first surface and a second surface, said first surface of said ring abutting said first surface of said plate, said first ring surrounding said first end of said range finder, said first ring having a plurality of first openings extending through said first surface and said second surface, said first openings being spaced apart from each other and distributed around said first ring; and a second ring having a primary surface and a secondary surface, said second ring being spaced from said first ring, said second ring surrounding said second end of said range finder, said second ring having a plurality of second openings extending through said primary surface and said secondary surface, each of said second openings being aligned with an associated one of said first openings.

4. The assembly according to claim 3, further comprising a plurality of rods, each of said rods having a first end and a second end, said first end of each of said rods being open, said second end of each of said rods being open, said first end of each of said rods extending through an associated one of said first openings, said second end of each of said rods extending through an associated one of said second openings.

5. The assembly according to claim 4, further comprising:

a washer being positioned on said secondary surface of said second ring;

a plurality of first fasteners, each of said first fasteners extending through said plate and engaging said first end of an associated one of said rods such that said rods are coupled to said plate; and a plurality of second fasteners, each of said second fasteners extending through said washer and engaging said second end of an associated one of said rods such that said second ring retains said range finder on said mount.

6. A rangefinder system comprising:

a bow being configured to launch an arrow, said bow having a stabilizer mount;

a range finder being configured to determine a distance between said bow and a target, said range finder having a first end and a second end;

a mount being coupled to said bow such that said mount is directed forwardly from said bow, said range finger being coupled to said mount such that said mount directs said range finder forwardly with respect to said bow, said mount comprising:

a plate having a first surface and a second surface, said plate including a bolt being coupled to and extending away from said second surface, said bolt being centrally positioned on said plate, said bolt threadably engaging said stabilizer mount on said bow such that said plate is coupled to said bow, a first ring having a first surface and a second surface, said first surface of said ring abutting said first surface of said plate, said first ring surrounding said first end of said range finder, said first ring having a plurality of first openings extending through said first surface and said second surface, said first openings being spaced apart from each other and distributed around said first ring, a second ring having a primary surface and a secondary surface, said second ring being spaced from said first ring, said second ring surrounding said second end of said range finder, said second ring having a plurality of second openings extending through said primary surface and said secondary surface, each of said second openings being aligned with an associated one of said first openings, a plurality of rods, each of said rods having a first end and a second end, said first end of each of said rods being open, said second end of each of said rods being open, said first end of each of said rods extending through an associated one of said first openings, said second end of each of said rods extending through an associated one of said second openings, a washer being positioned on said secondary surface of said second ring, a plurality of first fasteners, each of said first fasteners extending through said plate and engaging said first end of an associated one of said rods such that said rods are coupled to said plate, and a plurality of second fasteners, each of said second fasteners extending through said washer and engaging said second end of an associated one of said rods such that said second ring retains said range finder on said mount; and a switch being coupled to said bow wherein said switch is configured to be manipulated, said switch being electrically coupled to said range finder such that said switch turns said range finder on and off; and a display being movably coupled to said bow wherein said display is configured to be visible, said display being electrically coupled to said range finder, said display displaying indicia when said range finder is turned on, said indicia comprising numbers wherein said display is configured to display a distance between said range finder and the target.

* * * * *